US006164238A

United States Patent [19]

Stokes

[11] Patent Number: 6,164,238

[45] Date of Patent: Dec. 26, 2000

[54] LIGHTWEIGHT FOLDING BOAT WITH TENT AND TRAILER

[76] Inventor: Scott Alan Stokes, 630 Cramer St., Mazomanie, Wis. 53560

[21] Appl. No.: 09/437,129

[22] Filed: Nov. 10, 1999

[51] Int. Cl.[7] ..... B63B 7/00

[52] U.S. Cl. ..... 114/353

[58] Field of Search ..... 114/352, 353, 114/354; 135/88.01, 88.03, 88.05, 88.13; 296/157, 107, 176, 165

[56] References Cited

U.S. PATENT DOCUMENTS

| | | | |
|---|---|---|---|
| 1,124,248 | 1/1915 | Anastasi | 114/353 |
| 2,365,446 | 12/1944 | Barton, Jr. | 114/353 |
| 2,984,845 | 5/1961 | Gregoire | 114/344 |
| 3,056,147 | 10/1962 | Straussler | 114/354 |
| 3,097,371 | 7/1963 | Rough | 144/344 |
| 3,121,238 | 2/1964 | Levinson | 114/344 |
| 3,257,987 | 6/1966 | Liard | 440/31 |
| 3,594,834 | 7/1971 | Steensen | 114/353 |
| 4,366,769 | 1/1983 | Lingeman | 114/352 |
| 4,768,454 | 9/1988 | Selken | 114/61 |
| 4,827,865 | 5/1989 | Yelderman | 114/353 |
| 5,009,184 | 4/1991 | Voldrich | 114/361 |
| 5,183,002 | 2/1993 | Parker | 114/353 |
| 5,450,809 | 9/1995 | Melton | 114/353 |
| 5,868,097 | 2/1999 | Spickelmire | 114/353 |

FOREIGN PATENT DOCUMENTS

| | | | |
|---|---|---|---|
| 111347 | 7/1968 | Denmark | 114/354 |
| 1194697 | 6/1970 | United Kingdom | 114/353 |
| 1336307 | 11/1973 | United Kingdom | 114/353 |

*Primary Examiner*—S. Joseph Morano
*Assistant Examiner*—Ajay Vasudeva

[57] ABSTRACT

A lightweight folding boat with tent and trailer described in which the boat includes dual hulls joined by quick disconnect hinges and draw latches in a manner which allows the hulls to be locked in a fixed open position, folded with one hull atop the other for storage and towing, or easily separated for manual portaging or use as two independent canoes. When in the folded position the raised cockpit mates on three of the four sides providing a sheltered opening to allow quick access to the interior or the hulls for gear storage. The boat includes internal storage compartments, sleeping cots and a table. The tent may be configured for partial to full protection from the elements and also may be used as a sail for propulsion. The trailer has movable supports which allow for the boat to be towed in the open or folded position and also allows the boat to be used as a tent camper while on land.

9 Claims, 3 Drawing Sheets

Fig.1
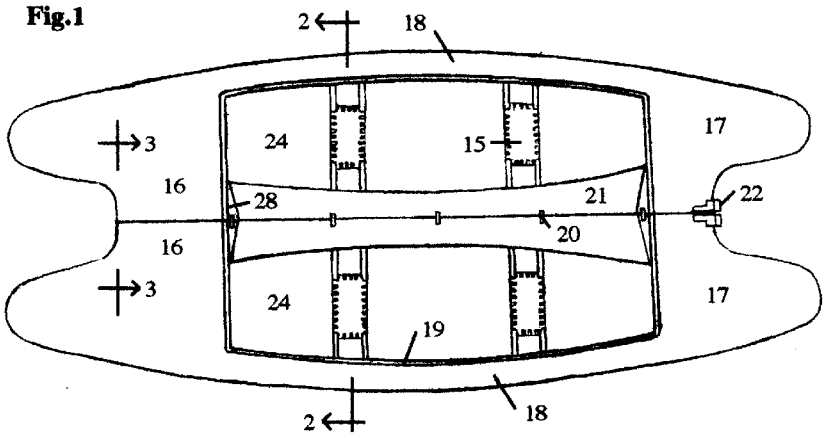
Fig. 2
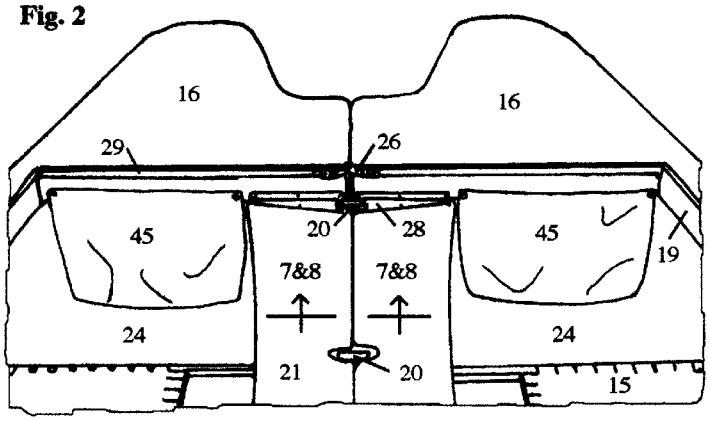
Fig. 3
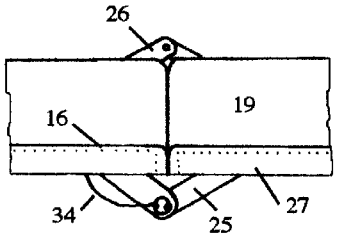
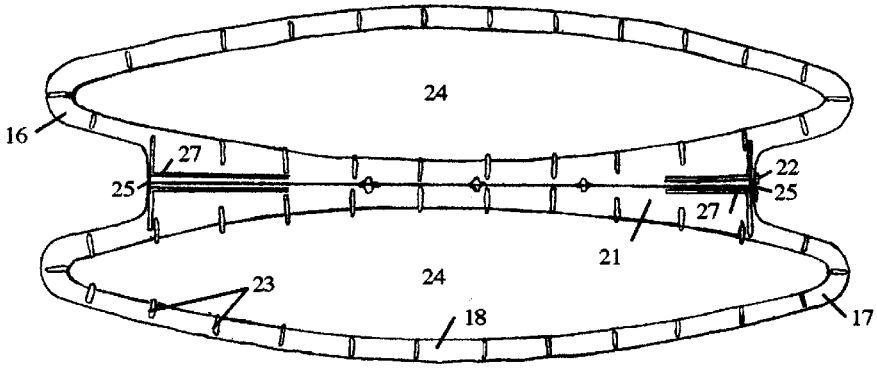
Fig. 4

Fig. 5
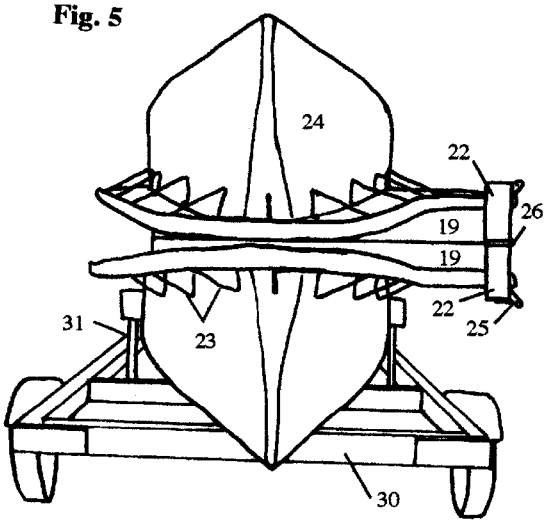
Fig. 6
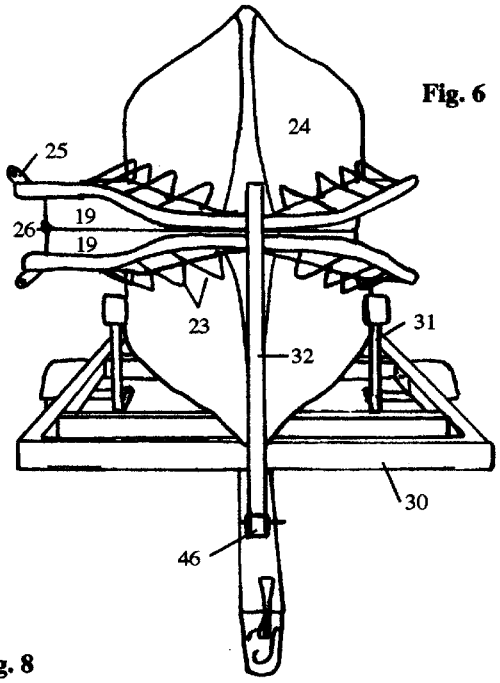
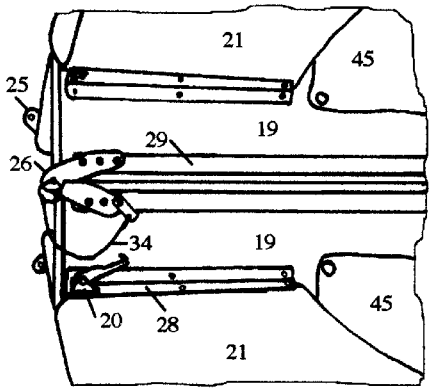
Fig. 7
Fig. 8
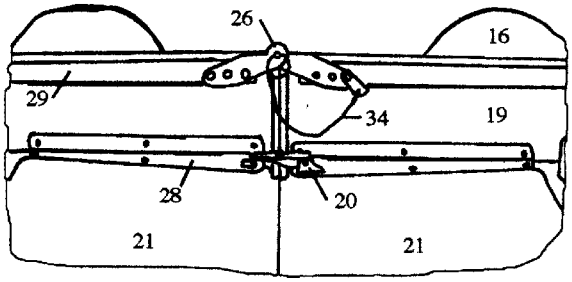
Fig. 9
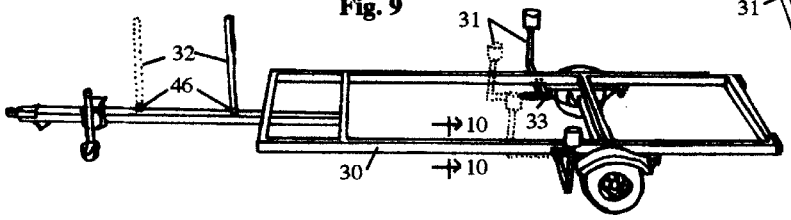
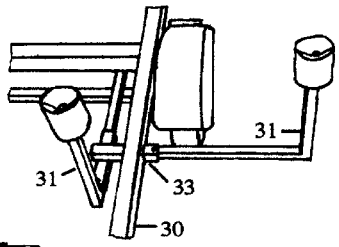
Fig. 10

LIGHTWEIGHT FOLDING BOAT WITH TENT AND TRAILER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to a multi-purpose lightweight folding boat with tent and trailer.

Folding and sectional boats have for many years been trying to solve some fundamental problems that confront boaters. A boat big and stable enough for family use typically weighs several thousand pounds making it difficult to store, transport, launch, or propel over the water and requires a powerful tow vehicle. They are also very limited in function as well as to the method of propulsion and the size and depth of the bodies of water they can be used on. While the following examples of prior art all deal with these problems to some degree, they all tend to be either to impractical, complicated and time consuming to assemble and use, or not versatile or efficient for many separate uses or conditions.

U.S. Pat. No. 2,984,845 to Gregoire is a folding boat that is towable, stable, lightweight, shallow draught and provides provisions for overnight use. One of the problems with this design is the absence of deck space outside of the tent enclosure that is often needed for maneuvering or alternate activities while the tent is erected. Another problem is the sleeping cots cantilever over the water creating dangerous instability in wind or rough water.

U.S. Pat. No. 3,121,238 to Levinson is a folding boat that doubles as a tent camper. This design is extremely complicated and time consuming to assemble and to configure for sleeping. It also is limited in its methods of propulsion.

U.S. Pat. No. 3,097,371 to Rough is a folding boat that stores and carries gear by forming an aerodynamic shape with a waterproof seal where the two halves meet. This design sacrifices efficient and versatile boat design in favor of cargo towing and storage ability.

U.S. Pat. No. 5,450,809 to Melton is a folding boat/cargo container that can be separated into two boats for portaging. Again this design makes for poor boating performance however configured.

U.S. Pat. No. 5,868,097 to Spickelmire is a folding boat and locking device to join the hulls. This locking device is improved upon and simplified.

BRIEF SUMMARY OF THE INVENTION

The purpose of this invention is to provide a much improved lightweight folding boat with tent and trailer that can be simply, quickly and efficiently configured for a wide variety of uses, conditions, transport and methods of propulsion on any body of water.

It is an object of this invention to provide a boat having lightweight dual hulls with decks secured together whereby one hull may be manually pivoted to a position overlying the other thereby reducing the boats width to improve towing characteristics and to reduce the space needed to store boat when not in use.

Another object of this invention is to provide a boat having lightweight dual hulls and decks secured together whereby one hull may be manually pivoted to a position overlying the other whereby the internal space of the hulls may be easily accessed by pivoting the top hull up or by using the sheltered opening along one side for the storage of the tent, equipment and other gear or luggage.

Still another object of this invention is to provide a new and improved boat having dual hulls that can be easily separated into two independent boats.

A further object of this invention is to provide a new and improved boat having dual hulls that can be easily separated to provide a means to manually portage the boat.

A still further object of this invention is to provide a new and improved means for coupling, pivoting or disconnecting the two hulls of the boat that does not require the use of tools.

Another object of this invention is to provide a boat with a tent enclosure for protection from the elements and which allows closed quarters for sleeping or the like.

Still another object of this invention is to provide a tent structure that may be used as a sail to propel the boat.

A further object of this invention is to provide decks outside of the cockpit area that drain directly to the water.

A still further object of this invention is to provide bow and stern decks with a recessed area that allow for lifting objects straight up from the water by straddling the recessed area thereby improving balance and strength when lifting, as well as for improved motor placement.

Another object of this invention is to provide bow and stern decks with a recessed area that allows improved entry and exit of the water for swimming or other water activities and to improve paddling from the decks.

Still another object of this invention is to provide decks that allow use when the tent is used in any configuration, that also provide convenient seating when the boat is on land or water.

A further object of this invention is to provide water resistant storage compartments at the ends of each hull with flaps that lay flat when open to allow full access to the compartments interior and are connected to the hull along the bottom and part way up the inside of the hull to seal out water that may accumulate in the bottom of the boat.

A still further object of this invention is to provide a fixed motor mount that allows the boat to be open, folded or separated.

Another object of this invention is to provide a trailer that carries the boat in both the open position or the closed pivoted position with one hull overlying the other.

Still another object of this invention is to provide a trailer that allows the boat to be used as a tent camper or as a storage compartment to transport gear and luggage when on land.

A further object of this invention is to provide a boat which is extremely difficult to capsize or sink.

Other objects and advantages of the invention will be apparent from the following description taken in conjunction with the accompanying drawings wherein:

BRIEF DESCRIPTION OF THE SEVERAL VIEWS OF THE DRAWING

FIG. 1 is a top plan view of the boat in the open, connected position.

FIG. 2 is an enlarged fragmentary perspective view taken substantially on the line 2—2 of FIG. 1.

FIG. 3 is an fragmentary detail perspective view taken substantially on the line 3—3 of FIG. 1.

FIG. 4 is bottom plan view of the boat.

FIG. 5 is a rear plan view of the boat in the closed folded position on the trailer.

FIG. 6 is a front plan view of the boat in the closed folded position on the trailer.

FIG. 7 is a fragmentary detail view of the boat in the folded position taken substantially on the line 7&8—7&8 of FIG. 2.

FIG. 8 is a fragmentary detail view taken substantially on the line 7&8—7&8 of FIG. 2.

FIG. 9 is a perspective view of the trailer.

FIG. 10 is a fragmentary detail view taken substantially on the line 10—10 of FIG. 9.

DETAILED DESCRIPTION OF THE INVENTION

Figure 11:
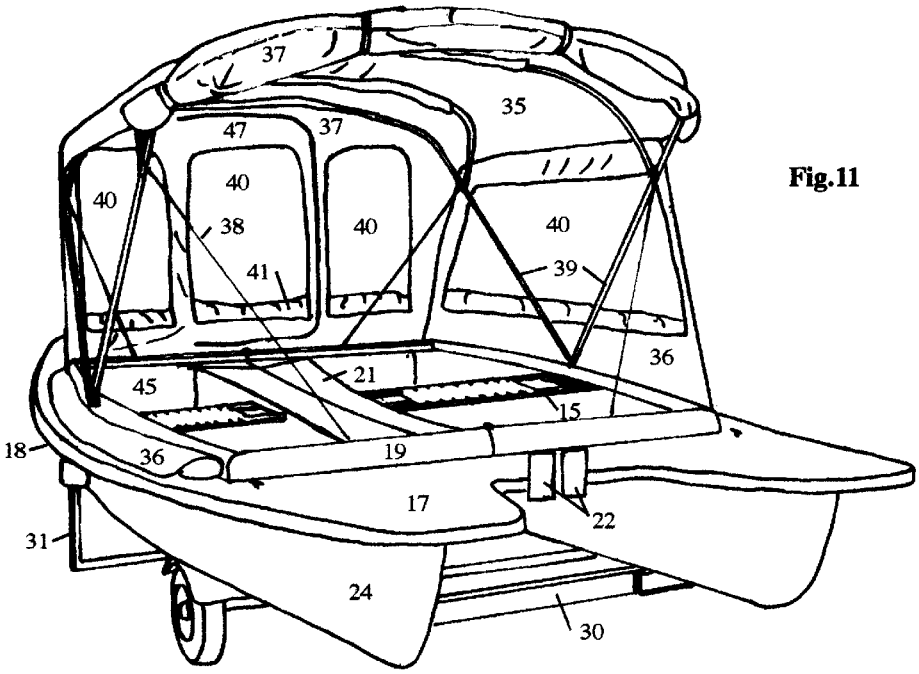
FIG. 11 is a perspective view of the boat on the trailer with the tent partially erected.

With continued reference to the drawing the present invention comprises a pair of lightweight canoe style hulls 24 that are formed with a flattened top mating surface with each hull halving a bow deck 16,a stern deck 17, a side deck 18, that are formed with a raised cockpit 19 and also a side deck with a flattened edge surface that forms half of the center deck 21. The bow and stern decks also have a flattened edge mating surface where they meet along the boats centerline when in the fixed open position. Under deck bracing 23 both supports the portion of the decks that overhang the hull and connect the decks to the hull when fastened both through the flattened top mating surface of the hull to the deck and to the deck itself without piercing the hull sides. All of the decks can support the weight of one or more adults and provide a seating surface on land or water. Each hull also contains two web seats 15 and two under deck water resistant storage compartments with closure flaps 45 that are glued to the hull bottom and part way up each side yet still lay flat when open. The motor mount 22 is formed in two halves with each half connected to a hull through the stern deck to under deck rigid L-shaped cross member 27. The hulls and decks may be formed of several lightweight marine materials including fiberglass or Kevlar™ over foam core, rotomolded polyethylene, foamed plastics or aluminum. In the preferred form, thermoformed Royalex™ is used because its composition can be configured as needed for weight, impact strength, stiffness, noise and temperature insulation and flotation. The closure flaps are made from any flexible waterproof marine fabric that can be bonded to the hull surface.

The two hulls are joined, pivoted and folded, or separated using a combination of latches and reinforcements made from aluminum, stainless steel or other suitable marine material. The center deck draw latches 20 are fastened in recesses along the center deck halves 21 and are fastened at the center deck ends through rigid cross members 28 to under deck rigid L-shaped cross member 27. Upper cockpit pivoting quick disconnect latches 26 with quick pin and lanyard 34 connect to rigid cross members 29 at the upper cockpit bow and stern. Under deck quick disconnect latches 25 with quick pin and lanyard 34 connect to rigid L-shaped cross members 27 at both ends of the center mating surface of the two boat halves.

When the boat is in the folded, pivoted position with one hull atop the other as shown in FIGS. 5&6, the raised cockpits 19 of each hull have a flattened top edge that together form a mating surface that both carries the weight of the top hull and forms a seal on three sides. FIG. 7 shows how the center deck halves form a sheltered opening that allows convenient access to the hulls interior, and also a detail of the latches when in the folded position.

The trailer 30 has a low profile to improve access to the boats interior and to facilitate use as a tent camper on land. The outside frame is centered under each hull when the boat is open to support the load of occupants and gear. When the boat is folded and moved to the center the movable supports also move to both support the boat and reduce the trailer width for improved towing and storage. FIG. 9 shows the alternate positions of the movable supports with solid lines shown for the open position and dotted lines showing the two positions. The front support 32 is secured with a quick pin at either of two low profile sockets 46 welded to the trailer tongue. The side supports 31 are secured with a quick pin into T-shaped square tube receiver 33 that is bolted to the trailer frame. Side supports have a pivoting rubber bumper that is visible above the waterline to improve launching or loading.

Figure 14:
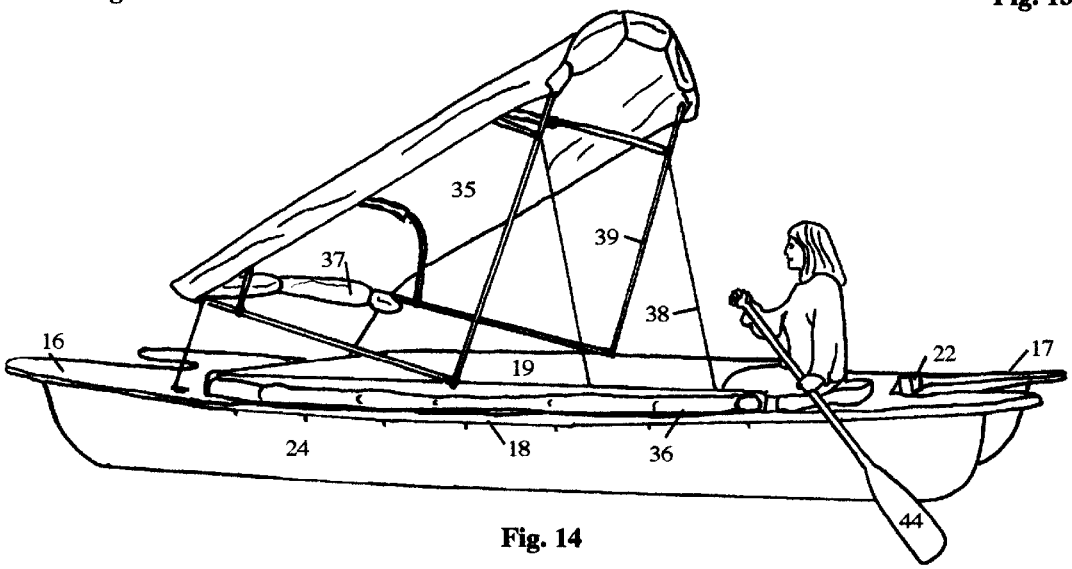
FIG. 14 is a perspective view of the boat showing the tent configured as a sail.

The tent is very versatile and can be configured in a variety of ways for many uses and conditions. FIG. 11 shows one configuration with the tent top 35, two side panels 36 with one rolled down, fastened to the cockpit and stored on a side deck and the other fastened to the tent top and front panel with a zipper, and with snap connectors along the cockpit. The side panels contain window openings 40 that may be covered with clear vinyl, screen or privacy flaps 41 shown rolled and secured. The tent front and back panels 37 are sewn to the top and are shown with one panel rolled up and and secured and one panel down and snapped to the cockpit. Front and back panels also have windows and door openings 47 shown zipped shut. The tent poles 39 are connected to the cockpit and braced with adjustable straps 38 that clip to the upper cockpit rigid cross members. FIG. 14 shows another configuration with the the tent and tent structure tipped forward for use as a sail and using a paddle 44 as a rudder. When in this configuration the tent can be pivoted upright for protection from the sun or rain or be quickly lowered to the front deck. The tent side poles disconnect so that the tent and tent structure fit in a boot that can be stored inside the hulls when the boat is folded.

Figure 12:
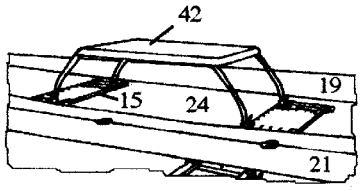
FIG. 12 is a perspective view of the table.

FIG. 12 shows a lightweight table 42 with a strap and snap connector on each leg that allows it to be secured between the two seats 15 as shown, with one leg secured to all four seats straddling the center deck, or for use on the bow or stern deck. When secured as shown it does not interfere with the folding of the boat and also secures the tent between the table and cockpit 19.

Figure 13:
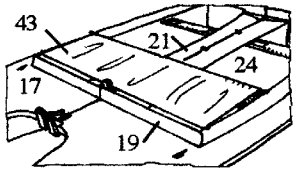
FIG. 13 is a perspective view of a sleeping cot.

FIG. 13 shows a sleeping cot 43 that connects to the raised cockpit 19 and is supported at the center deck 21 by attaching a U-shaped spreader. A cot may be set up at each end of the cockpit without interfering with the use of the seats or table and can be rolled up for storage.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What I claim as my invention is:

1. A combination of folding boat and trailer comprising:

a pair of lightweight canoe shaped hulls joined together in a manner that allows the hulls to be connected side by side in an open fixed position, manually pivoted and folded to a position with one hull overlying the other, or separated for portaging or independent use;

each hull having a bow deck, a stern deck and a first side deck which turn up along the interior edge to form a raised cockpit with a top mating surface that seals an internal hull area from the elements when one hull is manually pivoted to a position overlying the other;

each hull having a second side deck that forms half of a center deck when both said hulls are latched together side by side in the fixed, open position, and also providing a sheltered access opening to the hulls interior when in the closed, folded position;

each hull having a side mating surface that becomes the centerline of the boat when joined in the fixed, open position;

said bow and stern decks that when latched in the fixed, open position form recessed areas centrally between the outermost ends of the hulls, extending inwards between the hulls up to a point outside of the cockpit area.

2. The combination of claim 1, further comprising a motor mount formed in two halves and affixed side by side, with one half on each said stern deck with fasteners that extend through the deck to a stern under deck quick disconnect latch assembly in a manner that allows for a motor to be mounted when the boat is in the fixed, open position, or for the boat to pivoted and folded or separated.

3. The combination of claim 1, wherein said bow and stern decks when latched in the fixed, open position, provide a seating surface while on land or water.

4. The combination of claim 1, further comprising a means for joining, pivoting or separating the hulls without the use of tools, comprising of:

upper cockpit pivoting quick disconnect latch assemblies comprising a first hinge with a quick pin connector with each hinge-half fixed to a rigid cross member at the upper cockpit bow and stern thereby creating a latching pivot point;

under deck quick disconnect latch assemblies comprising a second hinge with a quick pin connector with each hinge-half fixed to a rigid L-shaped cross member below the center deck at both ends of the center mating surface of the two boat halves;

draw latches along the centerline of the boat that are reinforced both by a rigid cross member and below the center deck by a rigid L-shaped rigid cross member at the intersection of the center deck halves and the raised cockpit.

5. The combination of claim 1, further comprising a tent including a top, front and back panels each containing an access door and windows with privacy flaps, two side panels with windows, screens and privacy flaps, and a pivoting tent supporting structure that is adaptable to be configured in several positions for storage, protection from the elements, closed quarters for sleeping, and for use as a sail to propel the boat by either tilting the tent top and the supporting structure to a forward position to sail downwind, or using the tent top, the supporting structure and the side panels to sail crosswind.

6. The combination of claim 1, wherein said trailer comprises moveable supports for transporting or storing the boat in the open fixed position or the closed folded position, as well as for supporting the boat when used as a tent camper while on land, while carrying gear or luggage in a closed folded position, and as guides to position the boat on the trailer while launching or loading.

7. The combination of claim 1, further comprising water resistant storage compartments defined as a portion of the hull ends that are covered by the bow and stern decks and including closure flaps that lay flat when open to allow full access to the compartments interior and connected to the hull along the bottom and part way up an inside of the hull to seal out water that may accumulate in bottom of the boat when the closure flaps are closed.

8. The combination of claim 1, further comprising two seats within each hull, and a table adaptable to be secured between the two seats of one hull, or centrally between the two hulls and the four seats of the boat, that also acts to secure the tent within the hulls when the boat is in the folded position.

9. The combination of claim 1, further comprising sleeping cots adaptable to be secured to cockpit sides and supported at the center deck that do not interfere with the use of the seats or table and may be rolled for compact storage.

* * * * *